US005426947A

United States Patent [19]

Grenier

[11] Patent Number: 5,426,947

[45] Date of Patent: Jun. 27, 1995

[54] PROCESS AND APPARATUS FOR THE PRODUCTION OF OXYGEN UNDER PRESSURE

[75] Inventor: Maurice Grenier, Paris, France

[73] Assignee: L'Air Liquide, Societe Anonyme pour l'Exploitation des Procedes Georges Claude, Paris, France

[21] Appl. No.: 186,844

[22] Filed: Jan. 27, 1994

[30] Foreign Application Priority Data

Feb. 12, 1993 [FR] France ..... 93 01622

[51] Int. Cl.[6] ..... F25J 3/02

[52] U.S. Cl. ..... 62/25; 62/38; 62/43

[58] Field of Search ..... 62/24, 25, 38, 43

[56] References Cited

U.S. PATENT DOCUMENTS 4,303,428 12/1981 Vandenbussche ..... 62/38

4,746,343 5/1988 Ishizu et al. ..... 62/43

FOREIGN PATENT DOCUMENTS 0504029 9/1992 European Pat. Off. .

2674011 9/1992 France .

*Primary Examiner*—Ronald C. Capossé

*Attorney, Agent, or Firm*—Young & Thompson

[57] ABSTRACT

All the air to be distilled is compressed to a first high pressure and is thereafter separated into two portions. The first portion, representing at least 70% of the flow, is boosted to a second high pressure and cooled down in a heat exchanger to an intermediate temperature, where a part thereof is work expended to the mean pressure while the remainder is liquefied. The second portion is cooled and liquefied in the heat exchange line, into one or a plurality of flows at one or more pressures between the first and second high pressures.

13 Claims, 5 Drawing Sheets

PROCESS AND APPARATUS FOR THE PRODUCTION OF OXYGEN UNDER PRESSURE

The present invention relates to a process for the production of high pressure gaseous oxygen by air distillation in a double column apparatus including a mean pressure column which operates under a mean pressure, and a low pressure column which operates under a low pressure including the steps of pumping liquid oxygen withdrawn at the bottom of the low pressure column, and vaporizing of compressed liquid oxygen by heat exchange with air in the heat exchange line of the apparatus.

In what follows, the term "condensation" should be understood in a broad sense, i.e. also covering pseudo-condensation, at supercritical pressures.

FR-A-2,674,011 describes a process of this type in which all of the air is brought to a single high pressure, after which it is cooled and partially turbined at the mean pressure.

The invention aims at improving this known process so as to increase its thermodynamic performance without increasing the corresponding investment.

For this purpose, it is an object of the invention to provide a process of the type mentioned above, characterized in that:

all the air to be distilled is compressed, by means of the main air compressor of the apparatus, until reaching a first high pressure which is considerably higher than the mean pressure, and it is divided into a first and a second portion;

said first portion, which represents at least 70% of the flow of air being treated, is boosted until reaching a second high pressure;

at least he essential part of said first portion is cooled in the heat exchange line until reaching an intermediate temperature, at which point a part is expanded in a first turbine which is at the mean pressure, after which it is introduced into the mean pressure column, while the remainder keeps being cooled and is liquefied, expanded in an expansion valve and is introduced into the double column; and said second portion is cooled and liquefied, into at least one flow at at least one pressure between said first high pressure and said second high pressure, and, after expansion in an expansion valve, it is introduced into the double column.

According to the other characteristics:

the gaseous portion of the air from the first turbine is expanded in a second turbine, until reaching the low pressure, said gaseous portion being partially reheated before its expansion in the second turbine and the exhaust of the latter being blown into the low pressure column, possibly after cooling;

the air is brought to the first high pressure by means of a part only of the stages of the air compressor, the air is purified by removing water and carbon dioxide at this first high pressure, and said first portion is compressed by means of the last stage(s) of this compressor;

at least part of the air which exits the last stage of the compressor is boosted by means of a blower which is coupled to the first turbine;

said second portion is precooled by means of a refrigerating unit before introducing it in the heat exchange line.

It is also an object of the invention to provide an apparatus which is intended for such process. This apparatus, of the type comprising a main air compressor, a double column for air distillation including a mean pressure column which operates under a mean pressure, and a low pressure column which operates under a low pressure, a pump for compressing liquid oxygen which is withdrawn at the bottom of the low pressure column, means for bringing part of the air to be distilled to a high pressure, and a heat exchange line, is characterized in that:

said means are adapted to bring all the air to be distilled to a high elevated pressure which is considerably higher than the mean pressure, and include means for boosting a first portion of this air, representing at least 70% of the flow of treated air, until reaching a second high pressure;

the heat exchange line includes means for cooling said first portion until reaching an intermediate temperature and for cooling further and liquefying part of this first portion, and means for cooling and liquefying the non-boosted air, into at least one flow at at least one pressure located between said first high pressure and said second high pressure; and the apparatus includes an expansion turbine in which the suction side is connected to the ducts for cooling air at the first high pressure, at an intermediate point of the heat exchange line, and whose exhaust is connected to the mean pressure column.

Embodiments of the invention will now be described with reference to the annexed drawings, in which.

Figure 1:
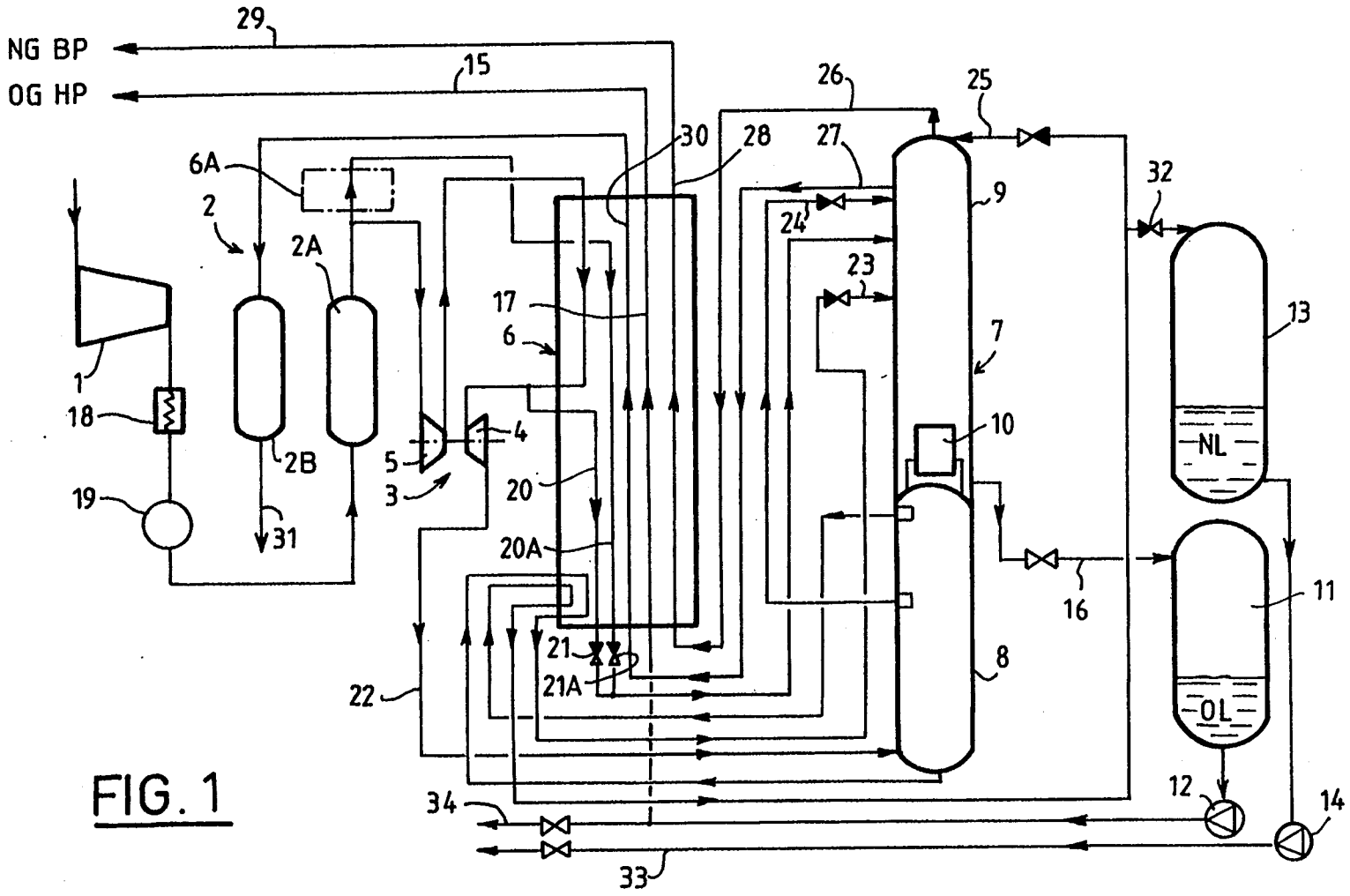
FIG. 1 is a schematic representation of an apparatus according to the invention.

The apparatus for air distillation illustrated in FIG. 1 essentially comprises: an air compressor 1, a device 2 for purifying compressed air by removing water and $CO_2$ by adsorption, this apparatus comprising two adsorption bottles 2A, 2B of which one operates by adsorption while the other is in the process of being regenerated; a turbine-blower combination 3 comprising an expansion turbine 4 and a blower or booster 5 in which the shafts are coupled, the blower being possibly provided with a refrigerating means (not illustrated); a heat exchanger 6 constituting the heat exchange line of the apparatus; a double distillation column 7 comprising a mean pressure column 8 surmounted by a low pressure column 9, with a vaporizer-condenser 10 establishing heat exchange relationship between the heat vapor (nitrogen) of column 8 and the bottom liquid (oxygen) of column 9; a liquid oxygen container 11 of which the bottom is connected to a pump for liquid oxygen 12; and a liquid nitrogen container 13 of which the bottom is connected to a pump for liquid nitrogen 14.

This apparatus is intended to supply, via duct 15, gaseous oxygen under a predetermined high pressure, which may be between a few bars and a few tens of bars (in the present description, the pressures under consideration are absolute pressures).

For this purpose, liquid oxygen withdrawn from the bottom of column 9 via a duct 16 is stored in container 11, is lead at high pressure through pump 12 in liquid state, then is vaporized and heated under this high pressure in ducts 17 of the exchanger 6.

The heat required for this vaporization and this heating, as well as for the heating and possibly the vaporization of other fluids withdrawn from the double column, is supplied by the air to be distilled, under the following conditions.

All the air to be distilled is compressed by means of compressor 1 at a first high pressure which is considerably higher than the pressure of mean pressure column 8, in practice higher than 9 bars. Then air, precooled at 18 and cooled to the vicinity of room temperature at 19, is purified in one, for example 2A, of the adsorption bottles, and divided into two portions.

The first portion, representing at least 70% of the flow of treated air, is boosted to a second high pressure by means of booster 5, which is operated through turbine 4.

The first air portion is then introduced into the hot end of the exchanger 6 and all of it is cooled until reaching an intermediate temperature. At that temperature, a portion of the air continues to be cooled and is liquefied in ducts 20 of the exchanger, after which it is expanded at to the pressure of the low pressure column 9 in an expansion valve 21 and is introduced at an intermediate level into column 9. The remaining air is expanded at the mean pressure in turbine 4 and is sent directly, via duct 22, to the base of column 8.

The second portion, possibly precooled at about −40° C. by means of a refrigerating until 6A indicated in broken lines, is introduced at the first high pressure into exchange line 6, cooled and liquefied until reaching the cold end of the latter in ducts 20A, expanded in an expansion valve 21A and combined with the flow which exits from expansion valve 21.

FIG. 1 shows the usual ducts of double column apparatus, the apparatus illustrated being of the so-called "top hat" type, i.e. with production of nitrogen at low pressure: ducts 23 to 25 for injection into column 9, in increasing amounts, of expanded "rich liquid" (oxygen enriched air), expanded "lower poor liquid" (impure nitrogen) at expanded "upper poor liquid" (almost pure nitrogen), respectively, these three fluids being respectively withdrawn from the base, at an intermediate point and at the top of column 8; and ducts 26 for withdrawing gaseous nitrogen originating from the top of column 9 and 27 for the evacuation of the residual gas (impure nitrogen) starting from the level of injection of the lower poor liquid. The low pressure nitrogen is heated in ducts 28 of the exchanger 6, then is recovered via duct 29, while the residual gas, after being heated in ducts 30 of the exchanger, is used to regenerate an adsorption bottle, bottle 2B in the example under consideration, before being evacuated via duct 31.

FIG. 1 also shows that a portion of the mean pressure liquid nitrogen is, after expansion in a expansion valve 32, stored in container 13, and that liquid nitrogen and/or liquid oxygen is supplied via duct 33 (for nitrogen) and/or 34 (for oxygen).

Figure 2:
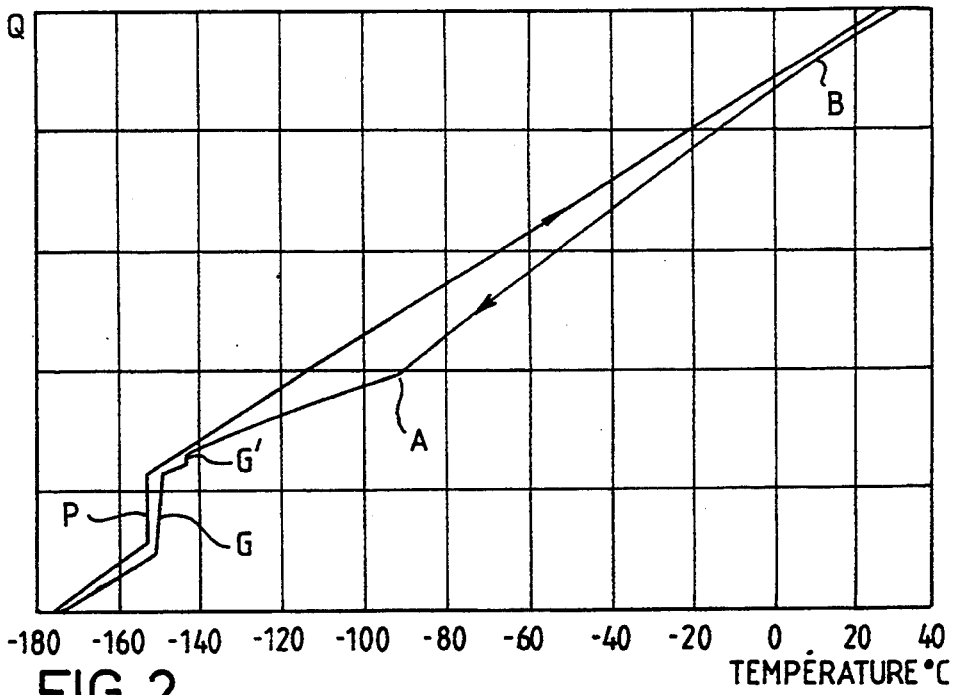
FIG. 2 is a heat exchange diagram, obtained by calculation, corresponding to the apparatus of FIG. 1, of a first mode of operation of this apparatus; on this diagram, the temperatures have been indicated on the x-axis, in degrees Celsius, and the quantities of heat exchanged are given on the y-axis.

As in the process of FR-A-2,674.011 mentioned above, for the choice of the pressure of boosted air, there are two possibilities:

When the product oxygen pressure is lower than about 20 bars, the air pressure is the condensation pressure of the air by heat exchange with oxygen during vaporization at the high oxygen pressure, i.e. the pressure for which the liquefaction knee G of one of the two portions of air, on the heat exchange diagram (temperatures in abscissa, quantities of heat exchanges in ordinates) is located slightly right of the vertical oxygen vaporization plateau P at the high pressure (FIG. 2). The temperature gap at the hot end of the exchange line is adjusted by means of turbine 4, the suction temperature of which is indicated at A. This gap is minimized, i.e. of the order of 2° to 3° C., towards a temperature of the order of +10° to +15° C., as indicated at B on FIG. 2, through the introduction at that temperature of the second portion of air in the heat exchange line. It is this characteristic, combined with the presence of the second liquefaction knee G′, corresponding to the liquefaction of the other portion of air, which enables to improve the heat exchange diagram over that shown in FR-A-2.674.011. It should be noted that this result may be obtained without additional devices. The presence of the refrigerating unit 6A increases this favorable phenomenon further. The diagram of FIG. 2 corresponds to the following numerical values: first high pressure: 24.5 bars; product oxygen pressure: 10 bars; second high pressure: 31 bars; second portion of air: 28% of the inlet flow; relative amount of liquefied portion at 20: very low; production of liquid: 40% of the quantity of separated oxygen.

When this product oxygen pressure is higher than about 20 bars, an air pressure between 30 bars and the air condensation pressure in oxygen during vaporization, is selected. In this case (FIG. 3), the knees of liquefaction of the two portions of air are moved back towards the left with respect to the oxygen vaporization plateau P, and the suction temperature of the turbine becomes lower than that of plateau P. Following this, a large portion of the turbined air is in liquid form at a mean pressure, and the refrigerating status of the apparatus is equilibrated, with a temperature gap at the hot end of the heat exchange line of the order of 3° C., by withdrawing from the apparatus at least one product (oxygen and/or nitrogen) in liquid form via ducts 33 and/or 34. When the air pressure is of the order of 30 bars, this equilibrium is obtained for a liquid withdrawal of about 25% of the production of gaseous oxygen under elevated pressure, which proportion is increased if the air pressure is higher than 30 bars.

Figure 3:
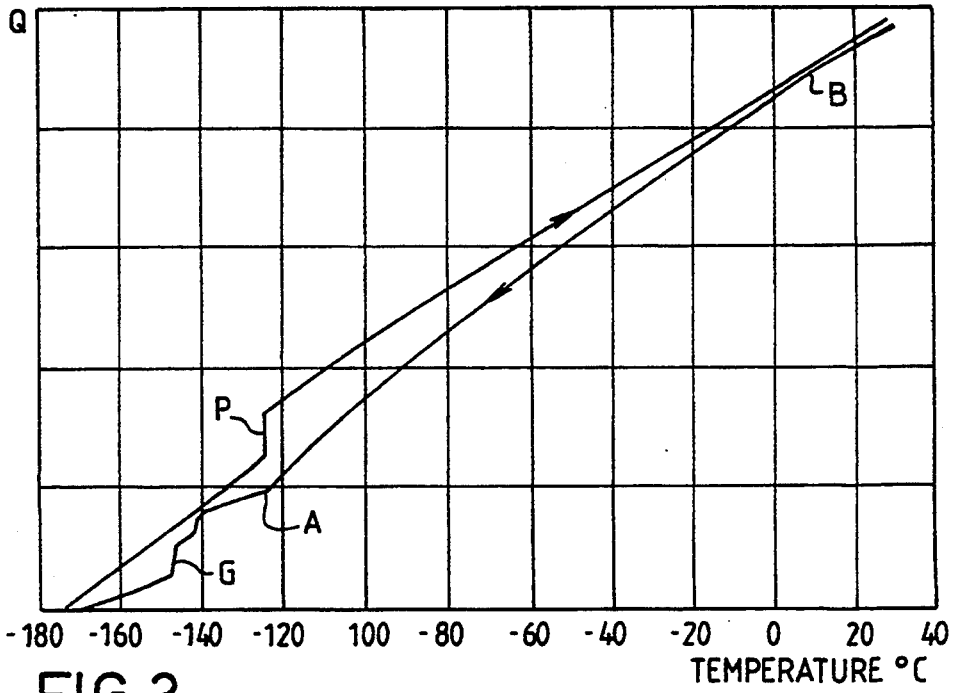
FIG. 3 is a diagram similar to that of FIG. 2 but corresponding to another mode of operation of the apparatus of FIG. 1.

The diagram of FIG. 3 corresponds to the following numerical values: first high pressure: 28.5 bars; purifying temperature: +12° C.; second portion of air: 11% of the inlet flow; second high pressure: 36.4 bars; expanded portion at 4 at 5.7 bars: 77% of the inlet flow; liquefied portion at 20: 12% of the flow of inlet air; product oxygen pressure: 40 bars; production of liquid: 35% of the quantity of oxygen separated.

Figure 4:
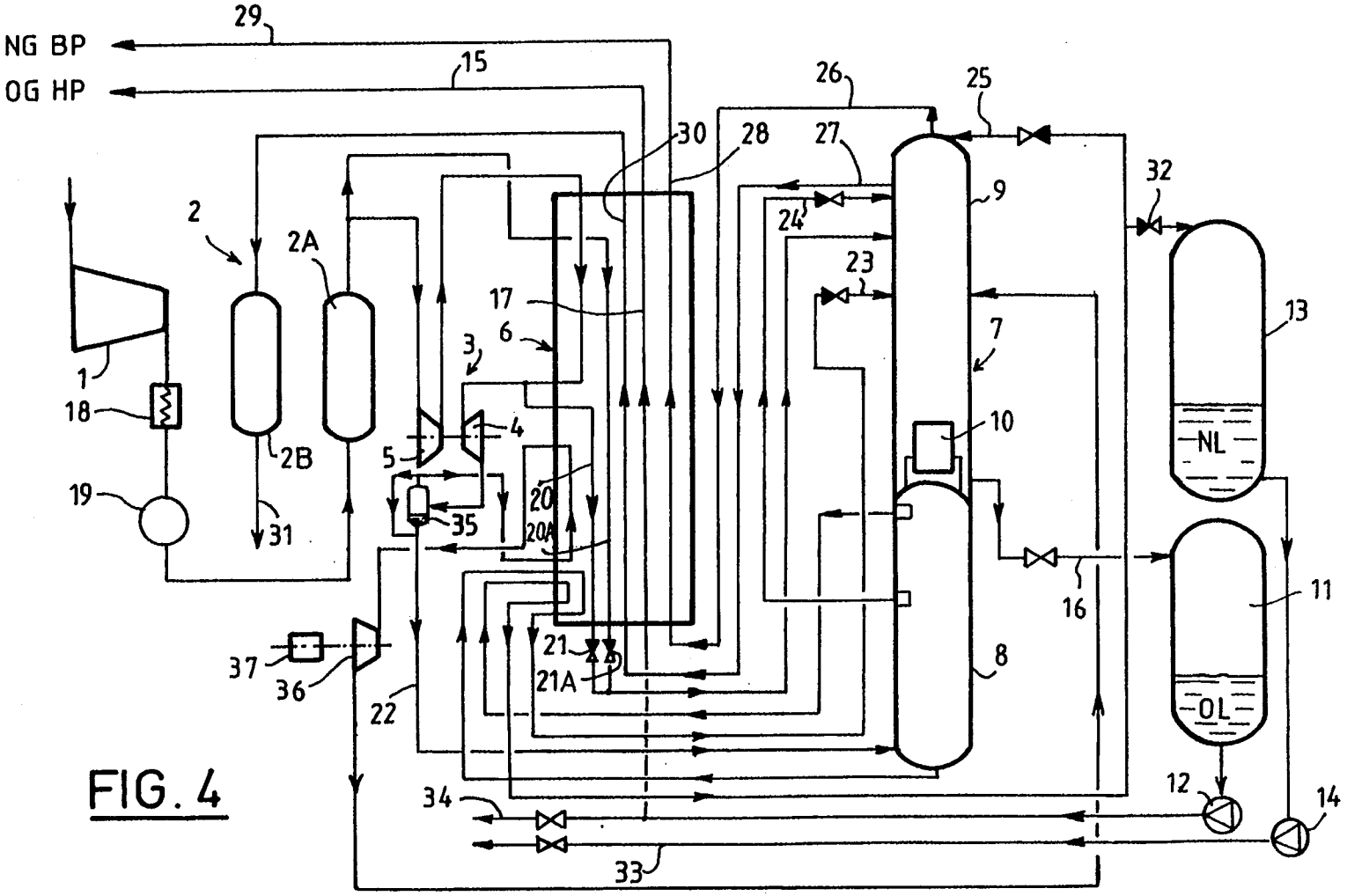
FIGS. 4 and 6 are views which are analogous to FIG. 1 and which respectively represent three variants of the apparatus according to the invention.

In the variant of FIG. 4, the air from turbine 4 is sent into a separating pot 35. The resulting liquid phase is directly sent to column 8, while the gaseous phase is, after partial heating in the heat exchange line, expanded at low pressure in a second turbine 36 which is provided with an appropriate brake 37, then is blown into column 9. This variant enables either to produce impure oxygen under good energy conditions due to the increase of the production of liquid which results from the presence of the second turbine, or to increase the production of liquid at the expense of the quantity of oxygen separated, or to produce only liquid oxygen.

Figure 5:
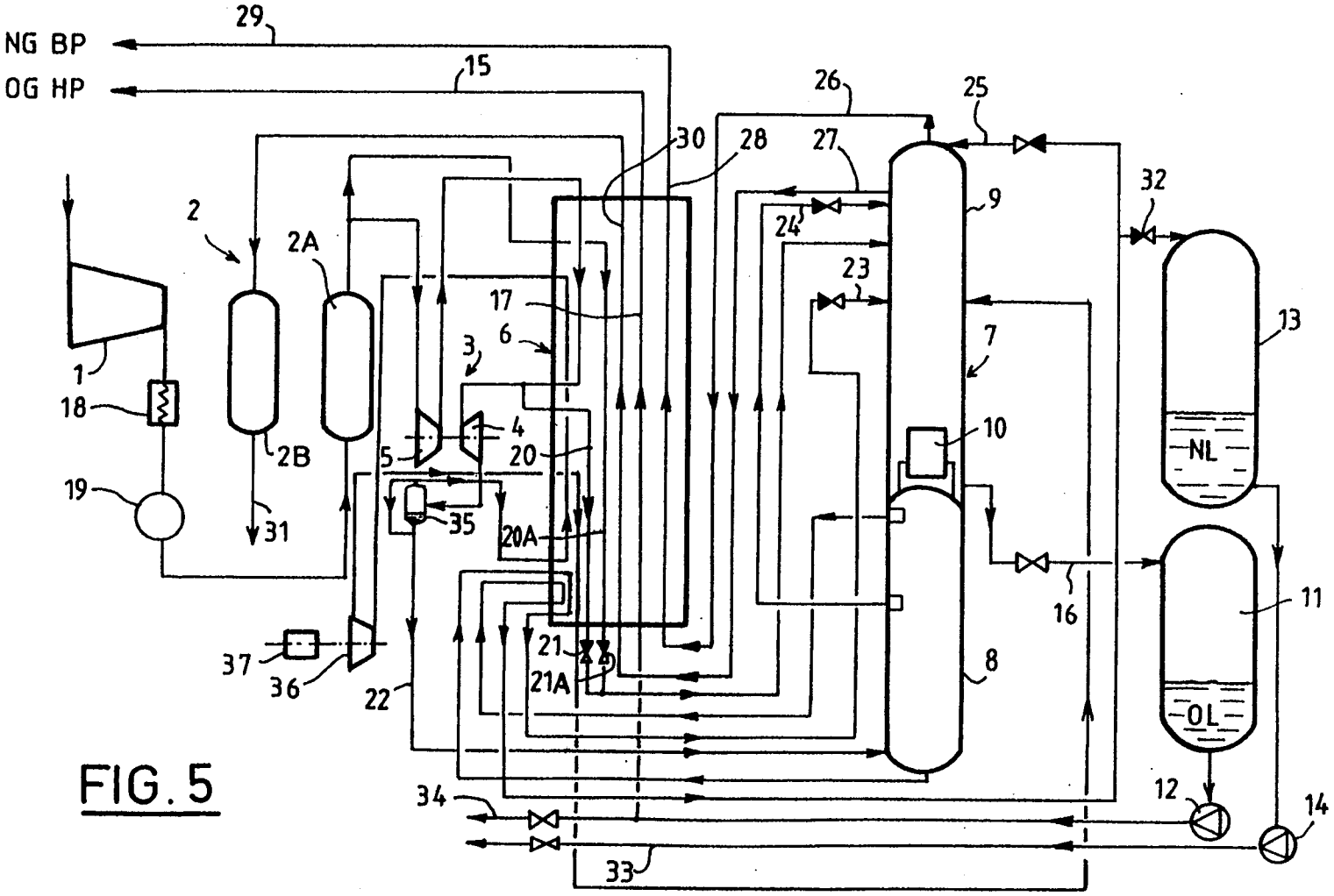

As illustrated in FIG. 5, it may then be preferable, within the same context, to warm up the gaseous phase which exits from separator 35 until reaching a temperature higher than the inlet temperature of the main turbine 4, before introducing this gaseous phase into the inlet of the turbine 36. In this case, it may be necessary, as illustrated, to introduce into the heat exchange line, the air which escapes from turbine 36 and to cool it until reaching the cold end of this exchange line, before introducing it into column 8.

Figure 6:
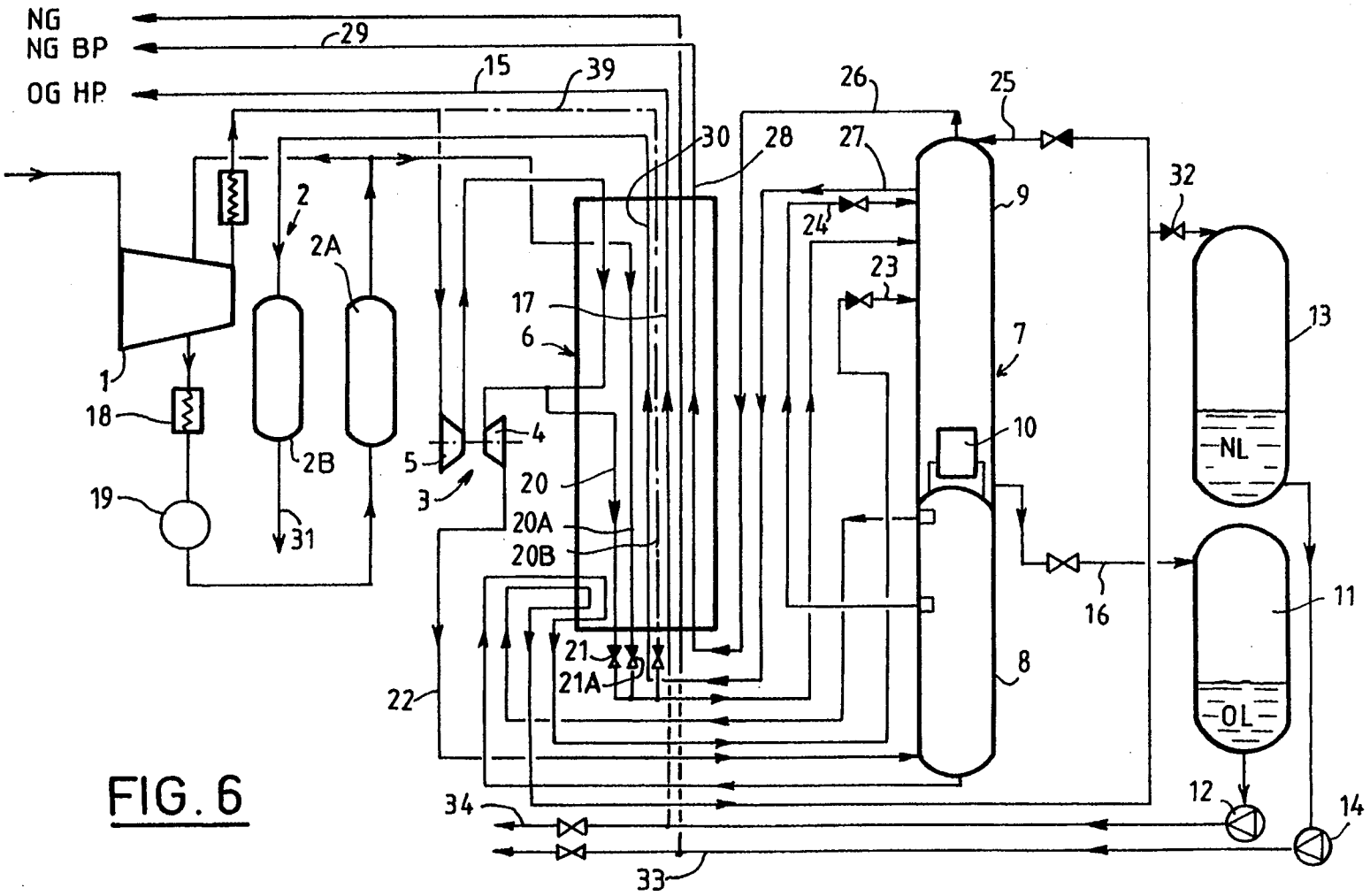

FIG. 6 illustrates another variant according to which the first high pressure is that of the penultimate stage of the main compressor 1. After purification at 2 at this pressure, the air is divided into two portions as previously. The first portion is reintroduced in the suction side of the last stage of compressor 1, and exits therefrom at a higher pressure. Then, after precooling at 38, this air is boosted to the second high pressure at 5 and is treated as explained above. The second air portion is directly introduced into ducts 20A of the heat exchange line.

Possibly, as indicated in broken lines, an air flow may be removed between precooler 38 and blower 5 and be sent via duct 39 in other ducts 20B of the heat exchange line, consequently at an intermediate pressure between the first and second pressures.

It has also been shown on FIG. 6 that the apparatus may produce, in addition to low pressure gaseous nitrogen which comes directly from the top of column 9 and the high pressure gaseous oxygen, also gaseous nitrogen under pressure, obtained by vaporization in the heat exchange line of a flow of liquid nitrogen removed from duct 33. This vaporization of nitrogen may possibly by carried out by condensation of the air contained in ducts 20, 20A or 20B.

Moreover, the apparatus may produce gaseous oxygen and/or gaseous nitrogen under at least two different pressures, as explained in FR-A-2.674.011 mentioned above.

Possibly, a small part of the air from the blower 5 may be further boosted by means of a second blower (not illustrated), for example coupled to turbine 36 of FIG. 5, before being cooled and liquefied in the heat exchange line, according to the teaching of application EP-A-504.029.

I claim:

1. Process for the production of gaseous oxygen at high pressure by air distillation in a double column apparatus including a mean pressure column which operates at a mean pressure, and a low pressure column which operates at a low pressure, comprising the step of compressing all the air to be distilled by means of a main air compressor to a first high pressure higher than said mean pressure, and dividing said compressed air into first and second portions, said first portion comprising at least 70% of the air treated;

boosting said first portion to a second high pressure higher than said first high pressure;

cooling the first portion in a heat exchange line to an intermediate temperature, dividing the cooled first portion into first and second parts, expanding said first part of said cooled first portion in a first turbine to the mean pressure and introducing said expanded part into the mean pressure column cooling and liquefying said second part of said cooled first portion, expanding said liquefied second part of said first portion in an expansion valve and introducing said expanded second part into the double column;

cooling and liquefying said second portion and, after expansion in an expansion valve, introducing said second portion into the double column;

pumping liquid oxygen withdrawn at the bottom of the low pressure column; and vaporizing pumped liquid oxygen by heat exchange with air in a heat exchange line of the apparatus.

2. Process according to claim 1, including expanding a gaseous portion of the air from the first turbine in a second turbine, this gaseous portion being partially warmed up before its expansion in the second turbine and the exhaust of the latter being blown into the low pressure column.

3. Process according to claim 1, wherein the main compressor has a plurality of stages comprising at least one initial stage and at least one final stage, the air is brought to the first high pressure by means of at least one said initial stage of the main air compressor, water and carbon dioxide are removed from the air while at this first high pressure, and said first portion is compressed by means of said at least one final stage of said main air compressor.

4. Process according to claim 3, wherein at least part of an air flow which exits said at least one final stages of said main air compressor is boosted by means of a blower coupled to the first turbine.

5. Process according to claim 1, wherein said second portion is precooled by means of a refrigerating unit before introducing said second portion into the heat exchange line.

6. Process according to claim 1, wherein said second portion is introduced into said low pressure column.

7. Apparatus for the production of gaseous oxygen at a high pressure, comprising a main air compressor, a double column for air distillation comprising a mean pressure column which operates under a mean pressure, and a low pressure column which operates at a low pressure, a pump for compressing liquid oxygen withdrawn from the bottom of the low pressure column, means for bringing a portion of the air to be distilled to a high pressure, and a heat exchange line, wherein:

said means are adapted to bring all the air to be distilled to a first high pressure higher than the mean pressure, and comprise means for separating the air at said first high pressure into a first portion and a second portion, means for boosting said first portion, representing at least 70% of the flow of air being treated, to a second high pressure higher than said first high pressure;

the heat exchange line comprises means for cooling said first portion down to an intermediate temperature and for cooling further and liquefying a part of this first portion, and means for cooling and liquefying non-boosted air, in at least one flow; and a first turbine having a suction side and an exhaust, said suction side being connected to ducts for cooling air at the first high pressure, at an intermediate point of the heat exchange line, and said exhaust being connected to the mean pressure column.

8. Apparatus according to claim 7, which comprises a second turbine for expanding to the low pressure at least part of an air flow which exits from the first turbine.

9. Apparatus according to claim 7, wherein said second portion originates from an intermediate stage of the main air compressor, the first portion being, after purification by removing water and carbon dioxide, reintroduced into this compressor.

10. Apparatus according to claim 9, which comprises a blower having a suction side coupled to the first turbine and having a suction side connected to an input of a last stage of the main air compressor.

11. Apparatus according to claim 7, which comprises a refrigerating unit for precooling said second portion of air upstream of the heat exchange line.

12. Apparatus according to claim 7, further comprising an expansion valve through which said liquefied non-boosted air is expanded prior to introduction into said double column.

13. Apparatus according to claim 12, wherein said expanded liquefied non-boosted air is introduced into said low pressure column.

* * * * *